US005957211A

United States Patent [19]

Geuken et al.

[11] Patent Number: 5,957,211

[45] Date of Patent: Sep. 28, 1999

[54] SHUT-OFF DEVICE FOR DUCTS AND THE LIKE

[76] Inventors: Stefan Geuken, Skogsviksvägen 1B, S-182 36 Danderyd; Niclas Yllner, Dalvägen 8, S-183 38 Täby, both of Sweden

[21] Appl. No.: 08/817,669

[22] PCT Filed: Oct. 19, 1995

[86] PCT No.: PCT/SE95/01230

§ 371 Date: Apr. 22, 1997

§ 102(e) Date: Apr. 22, 1997

[87] PCT Pub. No.: WO96/12525

PCT Pub. Date: May 2, 1996

[30] Foreign Application Priority Data

Oct. 24, 1994 [SE] Sweden ..... 9403645

[51] Int. Cl.[6] ..... F24F 11/02

[52] U.S. Cl. ..... 169/48

[58] Field of Search ..... 169/48; 454/309, 454/258, 357; 137/79

[56] References Cited

U.S. PATENT DOCUMENTS

| | | | |
|---|---|---|---|
| 2,096,271 | 10/1937 | Young | 454/309 |

FOREIGN PATENT DOCUMENTS

| | | | |
|---|---|---|---|
| 2 254 182 | 7/1975 | France | 169/48 |
| 2 052 683 | 5/1972 | Germany | 169/48 |
| 2 150 551 | 4/1973 | Germany | 169/48 |
| 2 154 841 | 5/1973 | Germany | 169/48 |
| 54-15189 | 2/1979 | Japan | 169/48 |
| 1448175 | 12/1988 | U.S.S.R. | 169/48 |
| 1 500 913 | 2/1978 | United Kingdom | 169/48 |
| 2 107 183 | 4/1983 | United Kingdom | 169/48 |
| 2 215 638 | 9/1989 | United Kingdom | 169/48 |

*Primary Examiner*—Harold Joyce
*Attorney, Agent, or Firm*—Hodgson, Russ, Andrews, Woods & Goodyear, LLP

[57] ABSTRACT

In order for a duct shut-off device to present the least possible resistance to flow in a duct when the device is in a non-activated state, a duct section (1) is provided with plates (3) which extend longitudinally in the flow direction and which are coated with an expandable material which reacts when the temperature, pressure or some other physical or chemical property of a substance flowing through the duct exceeds a given threshold level. When this threshold level is exceeded, the expandable material on the plates will swell and therewith reduce the cross-sectional area of the duct successively until the duct is completely close.

6 Claims, 3 Drawing Sheets

SHUT-OFF DEVICE FOR DUCTS AND THE LIKE

TECHNICAL FIELD

The present invention relates to means for preventing the spreading of gaseous substances in ducts, pipes or like elements, for instance for preventing the spreading of fire or harmful substances in ventilation systems.

BACKGROUND ART

A duct shut-off device which is self-acting in the event of fire and which is intended particularly for use in ventilation ducts is known from SE-B-7602567-5 (Publication No. 401 614). This known shut-off or closure device is comprised of a grating made of supportive cellular material having cells which extend through the grating from one surface to another and which are defined by strip-like cell walls which are coated with a material which will swell when heated. When heated, this material will expand and block the cells, therewith effectively preventing fire from spreading through a ventilation duct in which the device is fitted for instance.

FR-A-2 254 182 teaches a similar device where the grating is comprised of a plurality of parallel ribs which extend over the cross-sectional area of the duct. One drawback with this device is that when the device is closed the resultant increase in pressure of the flowing medium will be concentrated over a short section of the duct with the subsequent danger of the duct rupturing or fracturing.

SUMMARY OF THE INVENTION

With the intention of providing a duct shut-off or closure device which in a non-activated state will offer the lowest possible resistance to flow in ducting, or tubing, a section of a duct is fitted with plates which extend longitudinally in the flow direction and which are coated with an expandable material which reacts when subjected to heat, pressure or some other physical or chemical property of a substance flowing through the duct, above a given threshold level. When this threshold level is exceeded, the shut-off device is activated and the expandable material on the-plates swells and therewith successively reduce the cross-sectional area of the duct, until the duct is completely closed off. The longitudinally extending plates carrying the expandable material ensures that the duct will be closed even when the pressure increases as a result of the decrease in cross-sectional area. Because the pressure exerted by the flowing medium acts both radially and axially within a longer section of the duct, or tube, than in the case of the earlier known technique, the shut-off device will remain fully operative and there is no danger of the device becoming outwardly deformed, such outward deformation, or bulging, being liable to break the device and therewith allow fire smoke and toxic gases to pass through.

DESCRIPTION OF A PREFERRED EMBODIMENT

Figure 1A:
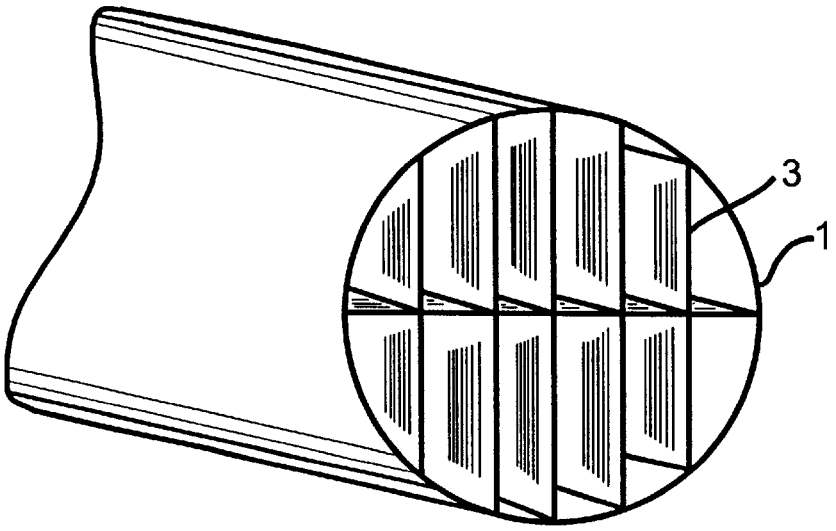
FIGS. 1A, 1B and 1C is a partial cross-sectional view of an inventive duct shut-off device which comprises internal vertically upstanding plates and a horizontal plate for fixing the vertical plates.
Figure 1B:
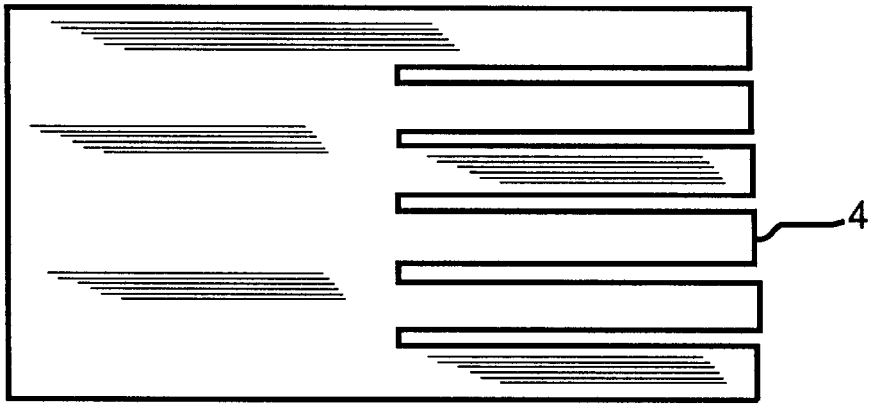
Figure 1C:
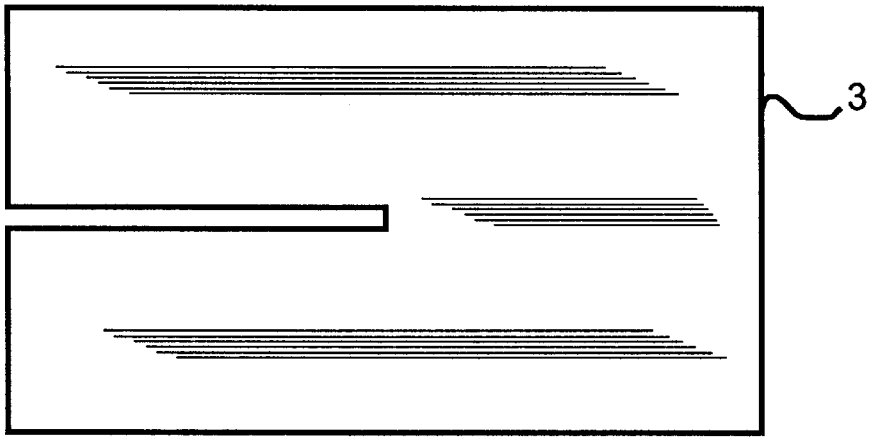
Figure 2:
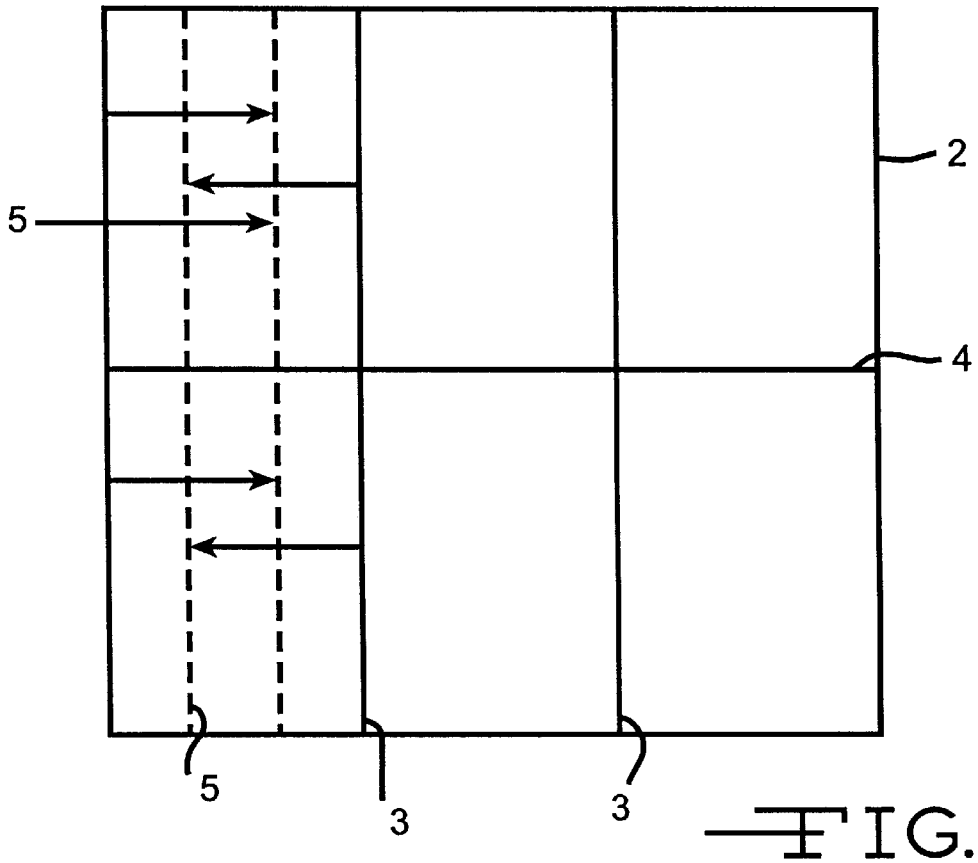
FIG. 2 is a cross-sectional view of a shut-off device for ventilation ducts of rectangular cross-section in accordance with the invention, and shows the expansion of an expandable substance.
Figure 3:
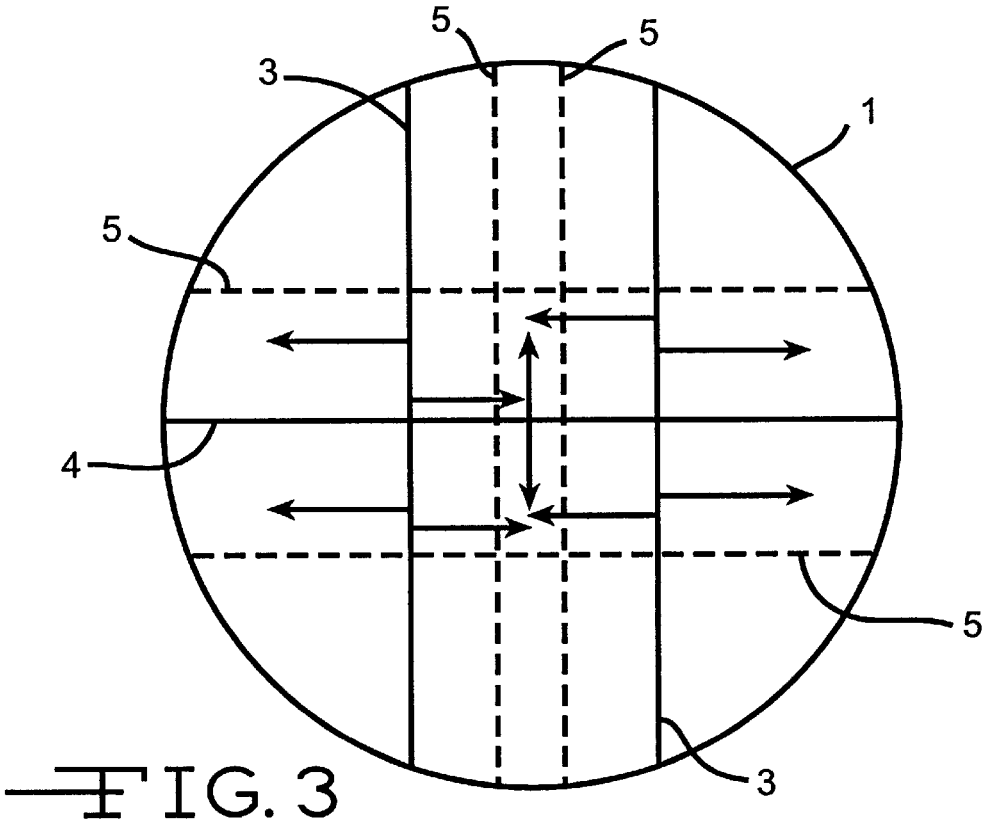
FIG. 3 is a cross-sectional view of an inventive ventilation duct shut-off device, and shows the expansion of an expandable substance.
Figure 4:
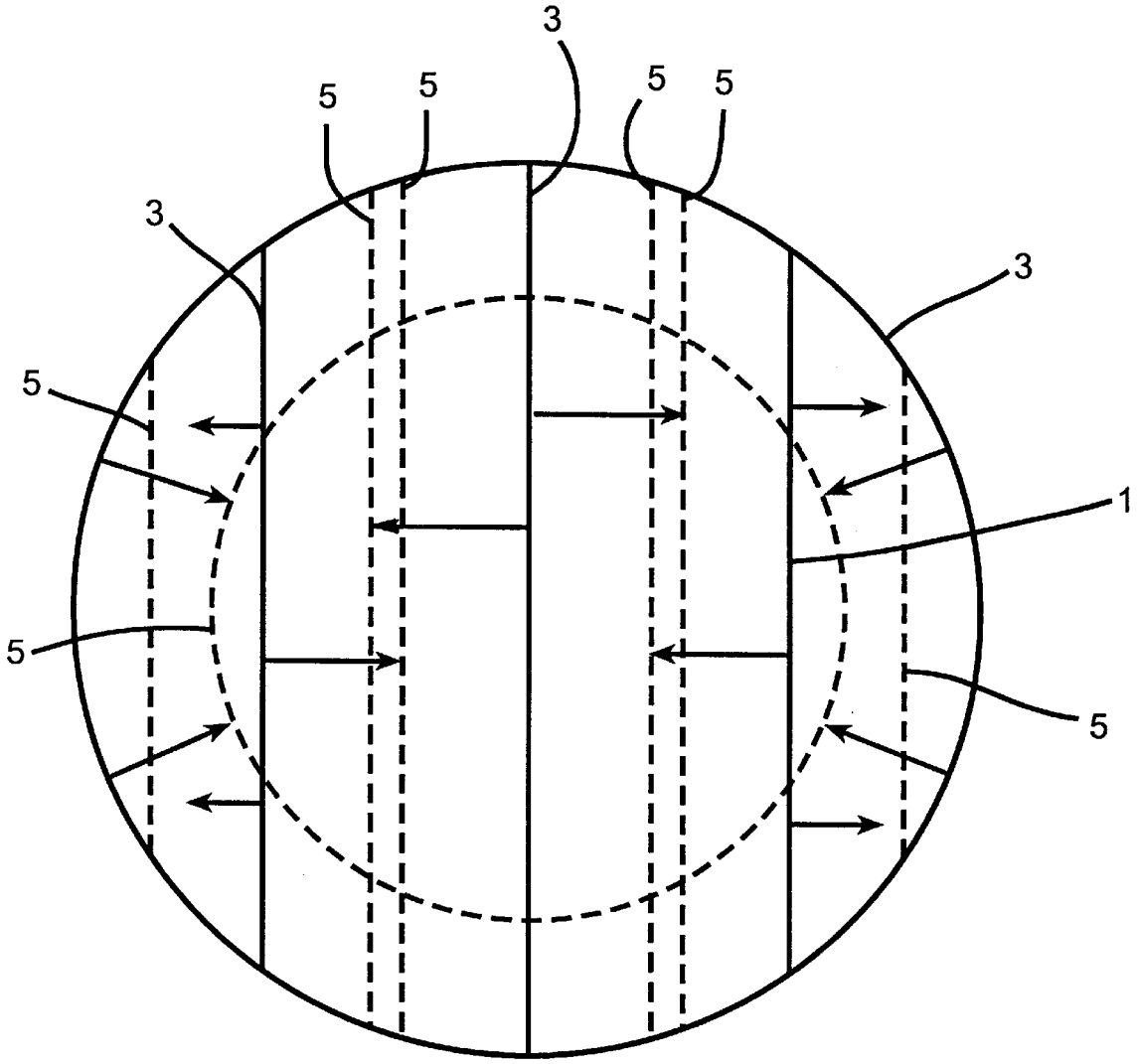
FIG. 4 is a cross-sectional view of a ventilation duct shut-off device in accordance with the invention, and shows the expansion of an expandable substance from inside the duct wall.

The drawings illustrate an inventive shut-off device comprised of a tube 1 or a channel 2 of rectangular cross-section for ventilation purposes for instance, having disposed therein longitudinally extending plates 3 which are coated with a layer of an expandable substance. In the case of horizontal ducting, the plates 3 are preferably inserted vertically to prevent any substantial downfall of particles in the duct and to simplify cleaning. In the case of ducting and channelling, shut-off devices can be incorporated therein as a well-defined duct section or channel section, where each section may include one or more plates 3, each being coated with an expandable material which will react, for instance, when a given temperature threshold is exceeded. The direction in which the material expands is indicated with arrows in the drawings, while the maximum expansion of the expandable material is shown in broken lines 5.

With the intention of preventing the spreading of fire from one room to another through ventilation ducts or channels, inventive duct shut-off devices can be fitted at those points along a ventilation system that are appropriate from a fire-spreading aspect, for instance between the floors of a multi-floor building or in the vicinity of places which contain inflammable materials. The plates of the duct shut-off device may be coated with an expandable fire-protection material which will expand, or swell, to a minimum of 50 mm when heated to a temperature above 160° C. for instance. With a maximum distance of 80 mm between the plates 2 of the shutoff device, the duct section containing the plates will be closed-off when the fire-resistant material expands as a result of being heated to said excessive temperature, meaning that the spaces between the plates 3 and the duct wall or channel wall will be closed and sealed-off by the expanding material. The thus closed ventilation duct or channel will be effective in preventing fire from spreading to adjacent rooms and spaces connected to the same ventilation system.

The inventive duct shut-off device can be configured to fit all existing ventilation systems comprising ducts or channels of circular, rectangular or other cross-sectional shapes. The plates preferably have an extension in the flow direction that is greater than the largest dimension of the duct. The plates provided in the duct or channel section may be fixed with plate-fixing inserts 4, which may also be coated with an expandable material. The inventive shut-off device can be readily fitted to existing systems, by removing an appropriate length of an existing ventilation duct, for instance an existing ventilation duct can be cut through at two locations therealong, wherein the cut duct length corresponding to the length of a shut-off device is removed and the inventive shut-off device inserted in its place and there secured to re-form a continuous flow path. The shut-off device may also be fitted in a manner which will enable it to be easily removed for cleaning purposes.

To prevent the spreading of fire, all surfaces and plate inserts of a shut-off device may be rust-proofed and then coated with a fire-resistant paint, which if a dull or matt paint is used may be supplemented with a bright paint to prevent tarnishing. The fire-resistant paint will be a type of paint that is approved according to Nordtest for instance, and shall be capable of withstanding fire for at least 60 min. The paint will preferably be applied in a quantity corresponding to 300 $g/m^2$=160 $\mu$m. The fire-resistant paint may be applied by brushing, spraying or dipping. When the fire-resistant paint is completely dry throughout, a bright paint, for instance a latex paint, is applied in an amount corresponding to 150 $g/m^2$=40 $\mu$m. The complete fire-resistant surface will preferably have a thickness of 240 $\mu$m in a dry state. In certain applications, the outer surfaces of the shut-off device may also be treated in the aforesaid manner.

The inventive shut-off device avoids one of the major problems that face fire-fighting authorities, namely the problem of fire spreading through ventilation systems in large building structures and in industrial buildings.

We claim:

1. A shut-off device for preventing the spreading of gaseous substances in ducts including preventing the spreading of fire in ventilation systems, wherein a duct section (1) or channel section (2) of a ventilation system is fitted with plates (3) coated along substantially the entire length with an expandable material along the entire length which will expand when a state parameter is exceeded or when in the presence of a given substance, so as to fill the space between and externally of the plates (3) with expanded material and therewith close-off said section and prevent the throughflow of said gaseous substance, characterized in that the plates have an extension in the flow direction which is greater than the largest dimension of the duct (1) perpendicular to the longitudinal direction of the duct.

2. A device according to claim 1, characterized in that the inner mantle surface of said duct section is coated with said expandable material.

3. A device according to claim 1, characterized in that the outer mantle surface of said duct section is coated with said expandable material.

4. A device according to claim 1, characterized by the plates (3) being affixed with the aid of one or more slotted plate fixing inserts (4).

5. A device according to claim 1, characterized in that the device can be fitted to and dismantled from an existing ventilation system.

6. A device according to claim 1, characterized in that the plates (3) are vertically disposed.

* * * * *

UNITED STATES PATENT AND TRADEMARK OFFICE

CERTIFICATE OF CORRECTION

PATENT NO. : 5,957,211
DATED : September 28, 1999
INVENTOR(S) : Geuken et al.

It is certified that error appears in the above-identified patent and that said Letters Patent is hereby corrected as shown below:

Column 3,
Line 21, delete "along the entire length"

Signed and Sealed this

Thirtieth Day of September, 2003

JAMES E. ROGAN
*Director of the United States Patent and Trademark Office*